US008465023B2

(12) United States Patent
Scriven

(10) Patent No.: US 8,465,023 B2
(45) Date of Patent: Jun. 18, 2013

(54) SPELLING GAME

(76) Inventor: Dale R. Scriven, Upper Marlboro, MD (US)

( * ) Notice: Subject to any disclaimer, the term of this patent is extended or adjusted under 35 U.S.C. 154(b) by 219 days.

(21) Appl. No.: 12/926,090

(22) Filed: Oct. 26, 2010

(65) Prior Publication Data

US 2012/0098199 A1 Apr. 26, 2012

(51) Int. Cl.
*A63F 1/00* (2006.01)
*A63F 3/00* (2006.01)

(52) U.S. Cl.
USPC ..... 273/299; 273/272; 273/146

(58) Field of Classification Search
USPC ..... 273/299, 272, 146
See application file for complete search history.

(56) References Cited

U.S. PATENT DOCUMENTS

| | | | | |
|---|---|---|---|---|
| 1,556,344 | A | 10/1925 | Phimister | |
| 2,128,749 | A | 8/1928 | Koch et al. | |
| 3,984,106 | A * | 10/1976 | White | 273/243 |
| 4,243,225 | A * | 1/1981 | Levinrad | 273/272 |
| 4,773,651 | A * | 9/1988 | Papapavlou | 273/249 |
| 4,826,175 | A * | 5/1989 | Quatrino | 273/299 |
| 5,310,347 | A | 5/1994 | Brand | |
| 5,558,328 | A | 9/1996 | Krantz | |
| 5,657,994 | A | 8/1997 | O'Connor | |
| 5,794,933 | A | 8/1998 | Chalfin et al. | |
| 5,816,572 | A | 10/1998 | Chalfin | |
| 6,234,486 | B1 | 5/2001 | Wallice | |
| 6,575,468 | B1 | 6/2003 | Hall | |
| 6,824,136 | B2 | 11/2004 | Koopman | |
| 7,238,107 | B2 | 7/2007 | McVay, III | |
| 7,604,235 | B2 | 10/2009 | Wiegand | |
| 7,695,357 | B2 | 4/2010 | Fleury et al. | |
| 2004/0130097 | A1 | 7/2004 | Krug | |
| 2006/0237907 | A1 * | 10/2006 | Martin | 273/292 |

* cited by examiner

*Primary Examiner* — Benjamin Layno

(57) ABSTRACT

A word forming game for plural players, requiring formation of words from letters displayed on dice and cards. The cards may display plural letters, which may be color coded. Players forming a word may be restricted to using letters of one color coding scheme. The successful player must indicate manually such as by picking up a designated object that he or she is prepared to spell a word. Successful spelling results in a point award. A plurality of rounds of forming words is practiced. Cards utilized to spell a word in any one round are discarded and replaced, after which the next round is performed. The dice displaying letters are thrown to modify which letters are displayed for word forming purposes. After a number of rounds, that player having the highest cumulative point total is declared the winner.

9 Claims, 4 Drawing Sheets

SPELLING GAME

FIELD OF THE INVENTION

The present invention pertains to games, and more particularly to a game for plural players, which promotes and exploits word forming and spelling skills.

BACKGROUND OF THE INVENTION

Games predicated upon spelling skills are long established. Games such as Scrabble® require players to form words from tiles each bearing one letter. A number appearing as a subscript determines a valuation for scoring purposes. A game such as Scrabble® generally rewards a single skill set, that is, the ability to rearrange letters to form words. But different people have different mental abilities, and a game which appeals to only one skill or to a very limited skill set may cause others to lose interest.

SUMMARY OF THE INVENTION

The present invention promotes and exploits word forming skills but also may call into play other abilities. The apparatus of the novel game includes devices which display letters which may be utilized by players to form words. However, at least one type of device displays more than one set of letters, and obliges a player to decide between two and optionally among more than two sets of letters to use. The game may require a player to manipulate a manually manipulable object to signal readiness to form a word from the letters which have been presented, and may also require a player to verbally announce the intended word.

A system of color coding or establishing other visual coding determines the sets of letters. A player is constrained to use only one of the available sets.

The game is preferably played in plural rounds in which only one player may be the first to form a word and therefore the winner of that round.

Points are awarded for successful formation of words, subject to a number of constraining rules. Violations of the rules may result in penalties to a cumulative point score.

BRIEF DESCRIPTION OF THE DRAWINGS

Similar reference characters denote corresponding features consistently throughout the attached drawings.

DETAILED DESCRIPTION

Figure 1:
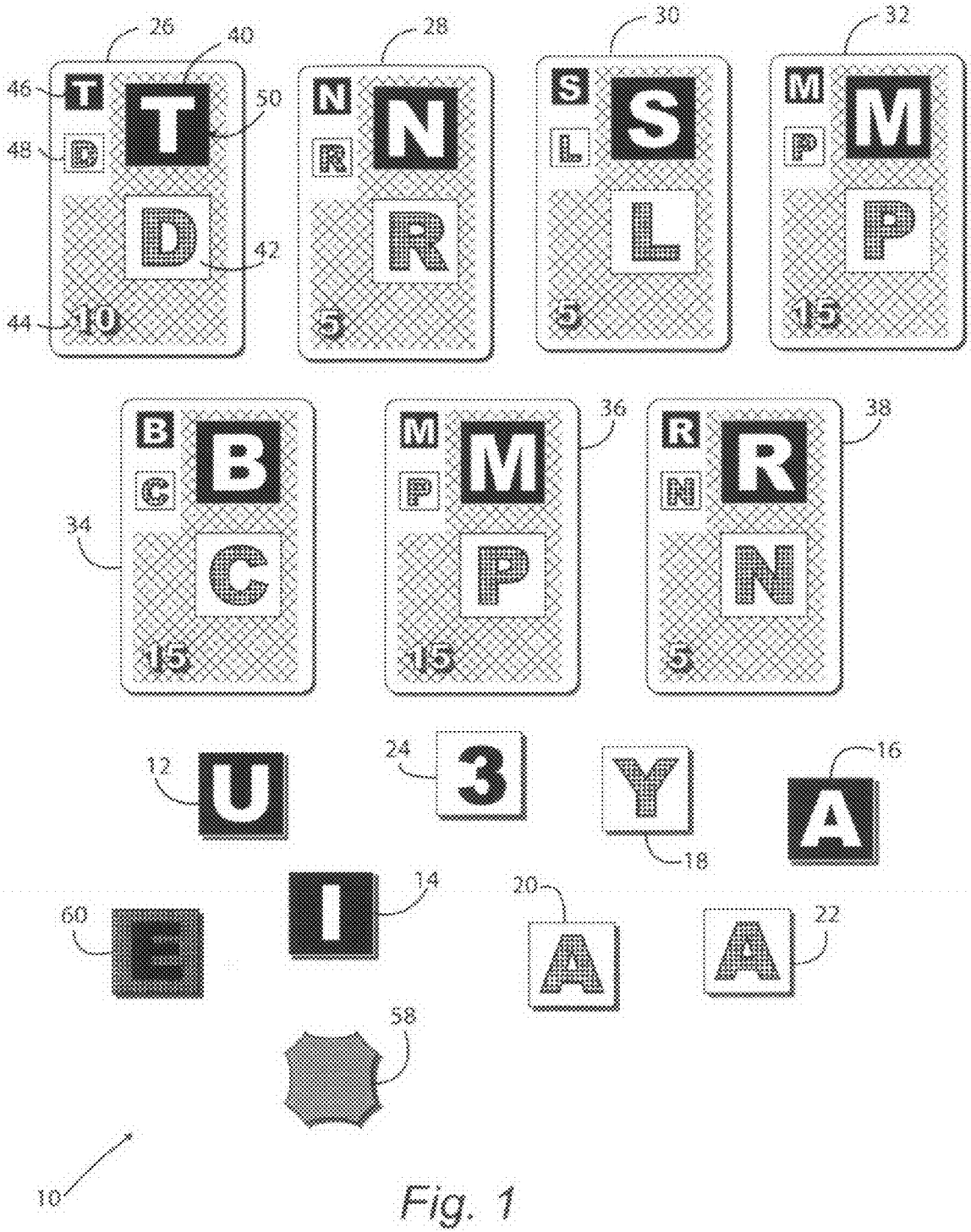
FIG. 1 is a plan view depiction of apparatus which may be used to play the novel game.
Figure 2A:
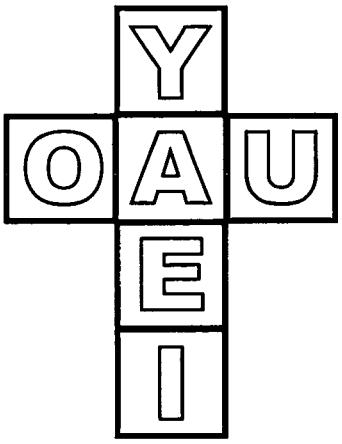
FIG. 2A is a diagrammatic, two dimensional representation of letter indicia which may be disposed on a six sided die included within the apparatus of FIG. 1.
Figure 2B:
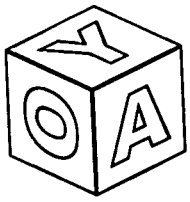
FIG. 2B is a perspective view of a six sided die displaying letter indicia in accordance with FIG. 2A.

Exemplary apparatus 10 for playing a word forming game according to the present invention is shown in FIG. 1. The apparatus 10 may comprise a plurality of dice 12, 14, 16, 18, 20, 22 each of which is seen to display a letter to the viewer. The dice 12, 14, and 16 are seen to have light colored letters imposed on a dark background. The dice 18, 20, and 22 are seen to have dark colored letters imposed on a light background. The die 24 displays a number. The apparatus 10 also comprises a plurality of cards 26, 28, 30, 32, 34, 36, and 38 each of which bears a plurality of letters and a number. Illustratively, the card 26 bears a letter "T" 40, a letter "D" 42, and in addition, a numerical value such as the number "10" 44. The letter "T" 40 is rendered in light lettering and is imposed on a dark background, in a manner generally identical to that of the dice 12, 14, and 16. Similarly, the letter "D" 42 is rendered in relatively dark lettering and is imposed on a light background, as is done with the dice 18, 20, and 22. This arrangement of visual contrast in the dice 12 . . . 22 and the cards 26 . . . 38 provides visual coding such that there is established a visually identifiable family or set of code related letters, such as those letters rendered in light lettering imposed on dark backgrounds, and a second visually related family or set of code related letters, such as those letters rendered in dark lettering imposed on light backgrounds. In this arrangement, at least one of the letters of each card 26, 28, 30, 32, 34, 36, or 38 is a member of one of at least two visually related families. Also, at least another one of the letters of each card 26, 28, 30, 32, 34, 36, or 38 is a member of another visually related family. Similarly, the plurality of dice 12, 14, 16, 18, 20, and 22 comprises at least one die (e.g., the die 12) which is visually coded as a member of one visually related family, and at least one other die (e.g., the die 18) which is visually coded as a member of another visually related family. Preferably but not necessarily, there are at least two dice (e.g., the dice 12 and 14) which are visually coded as members of the first visually related family, and at least two dice (e.g., the dice 18 and 20) which are visually coded as members of another visually related family. In an exemplary embodiment of the invention, each first visually related family may contain a set of three dice and each second visually related family may contain a set of three dice As seen in FIG. 1, the dice 12 . . . 22 may each have a plurality of faces each bearing a vowel letter. When six dice are used, such as the dice 12 . . . 22, a plurality of vowels of the alphabet are represented on the upwardly exposed faces of the dice 12 . . . 22. Indicia appearing on only the upwardly exposed faces of the dice 12 . . . 24 are in play at any one time. FIG. 2A is a diagrammatic representation showing an exemplary layout having the vowel letters A, E, I, O, U, and Y displayed on the six faces of any one of the dice 12 . . . 22, although the displayed vowels may be modified so that on any one die (not shown), one or more vowels may be duplicated, and one or more vowels may not be represented on that die. FIG. 2B is a perspective view of a six sided die displaying vowel letters in accordance with the layout of FIG. 2A.

The cards 26 . . . 38 may each have a face bearing a plurality of different letters, although it would be possible for the same letter to appear twice on any one card if desired (this option is not shown).

Figure 3A:
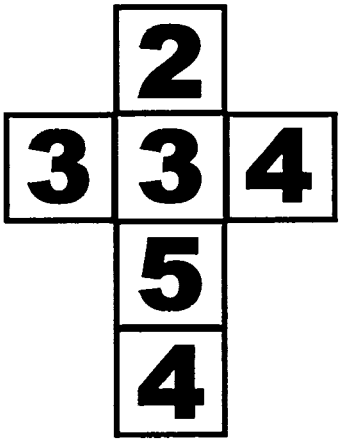
FIG. 3A is a diagrammatic, two dimensional representation of numerical indicia which may be disposed on a six sided die included within the apparatus of FIG. 1.
Figure 3B:
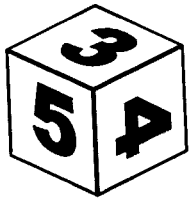
FIG. 3B is a perspective view of a six sided die displaying numerical indicia in accordance with FIG. 3A.

The apparatus 10 may also include a number display device which is a component unto itself, is visually unique so that its function is immediately discernible, and is functional to display a plurality of different numbers. This number display device may be a die having six faces each displaying one number, such as the die 24 for example. Because other dice such as the dice 12 . . . 22 are used, it would be desirable that the die 24 be visually distinct from the other dice, such as by size, and/or coloring, or in other ways. FIG. 3A is a diagrammatic representation showing an exemplary layout of a number arrangement which may be used on the die 24. It will be seen that the numbers displayed on the faces of the die 24 range in magnitude between two and five. More particularly, the faces of the number display die 24 may include one face displaying the number "two", two faces displaying the number "three", two faces displaying the number "four", and one face displaying the number "five". FIG. 3B is a perspective view of number die 24, in accordance with the layout of FIG. 3A.

As seen in the apparatus 10, the letters displayed on the dice 12 . . . 22 are vowels, whereas the letters borne on the faces of the cards 26 . . . 38 are consonant letters.

The apparatus described above may be supplemented by providing a small graspable object such as a die 58 (see FIG. 1) which may be uniquely shaped, or bear indicia, coloring, or other visual attributes which set it apart from other dice of the game, such as the dice 12 . . . 24. The die 58 may serve as a manually manipulative indicator to be manually manipulated by a player to indicate that that player is forming a word. The function of the die 58 may be satisfied by an entirely different type of object, such as a small figurine, a bean bag, or other device (none shown) for example.

The game may be modified to provide a wild letter feature. The wild letter feature designates either a specific letter which may be usable with letters of any of the visually identifiable families of letters, rather than being restricted to one of the visually identifiable families of letters, or alternatively, may signify that a player using the wild letter feature may select any letter of the alphabet at his or her discretion rather than being limited to a displayed letter, which alternative may or may not be restricted to one of the visually identifiable families of letters. The wild letter feature may be implemented on any of the letter bearing members, such as the dice 12 . . . 22 and the cards 26 . . . 38, so as to establish a wild letter bearing member.

The wild letter feature may be the subject of a dedicated apparatus such as the die 60. Again referring to FIG. 1, the wild letter die 60 may have coloring or other visual indication of wild letter status which signifies that the letter borne on the wild letter bearing member may be used in combination with any one of the visually identifiable families of letter bearing members. In an exemplary embodiment of the invention, wild letter die 60 may have a vowel letter layout like that shown in FIGS. 2A and 2B.

If there is a limited number of such wild letter die or dice such as the die 60, it follows that the number of letter combinations is less than that possible for a plurality of dice bearing more letters. Accordingly, a successful attempt to form a word using this relatively restricted set of letters available from the wild letter die 60 may be rewarded to a greater degree than a successful attempt to form a word using a greater pool of candidate letters.

To summarize, then, the apparatus of the game includes letter bearing members for displaying to each player letters which are available for spelling a word, such as the cards 26 . . . 38 and vowel bearing dice 12 . . . 22. In an exemplary embodiment of the invention, letter bearing members include cards such as the cards 26 . . . 38 and dice such as the dice 12 . . . 22, and may further include wild letter die 60. However, the letter bearing members need not be limited to cards such as the cards 26 . . . 38 and dice such as the dice 12 . . . 22 and wild letter die 60. Other letter display devices which preserve the feature combination of providing visually identifiable family coded letters together with separate letter sets, such as vowel and consonant sets, may be utilized. For example, vowel dice may be replaced with a set of vowel cards, or consonant cards may be replaced with consonant dice.

It will be appreciated that the nature of the letter bearing members may vary considerably between the dice 12 . . . 22 and the cards 26 . . . 38, the advantage of which is to provide readily distinguishable letter bearing members which are used individually by an individual player such as the cards 26 . . . 38 from letter bearing members which are used in common by all players such as the dice 12 . . . 22. However, if desired, letter bearing members may comprise only cards such as the cards 26 . . . 38 or only dice such as the dice 12 . . . 22, or any other device which is suitable for displaying the subject matter necessary to play the game as detailed herein.

Cards such as the cards 26 . . . 38 may be placed on a playing surface such as a tabletop (not shown) or if a player prefers, may be held in one hand as is commonly practiced in card games. To accommodate holding the cards, the letters borne on each card appear at least along the left side border of each card in a vertical array. Such an array assures that at least one representation of all of the letters borne on the card (i.e., using the card 26 as an example, the small letters "T" 46 and "D" 48) would be readable from the vertical array even if that card were mostly covered by another card, as usually occurs when cards are held in one hand in mostly overlapping fashion.

Cards such as the cards 26 . . . 38 may have designated spaces thereon for displaying letters, such as in the case of the card 26, that space defined within a light colored box or border 50 which surrounds the dark background of the letter "T" 40. Such a border 50 is optional, as the dark background that surrounds the letter "T" in card 26 forms a box itself, and forms a designated space for displaying letters. Further, the designated spaces on the cards for displaying letters are also distinguished by position, such as by being in an upper or lower position. Alternately, one designated space may have a background area that is larger than the background area of the other designated space. Alternately, a separate deck of vowel cards having letters that are correspondingly visually distinguished in the same fashion as the visually distinguished letters in the consonant deck may be provided in place of dice.

Figure 4A:
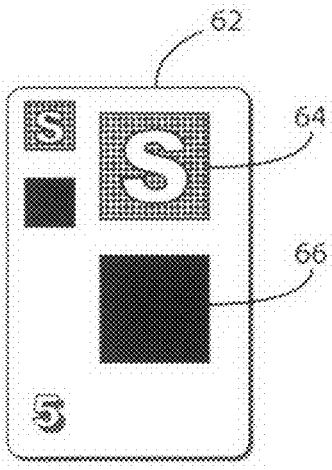
FIGS. 4A, 4B and 4C are plan views of playing cards of particular visual coding characteristics, which may be used with the apparatus shown in FIG. 1.
Figure 4B:
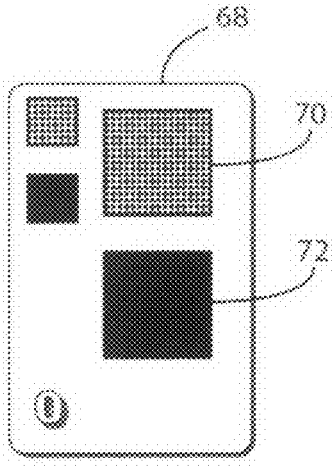

In an optional variation of the cards such as the cards 26 . . . 38, as seen in FIG. 4A, a card 62 may have designated spaces thereon for displaying letters, such as the spaces defined within the borders 64 and 66, wherein a designated space (such as that within the border 66) may be blank. FIG. 4B shows a card 68 having a further optional variation, wherein both designated spaces (such as that within the border 70 and that within the border 72) may be blank. A blank space may be designated as a wild letter.

Figure 4C:
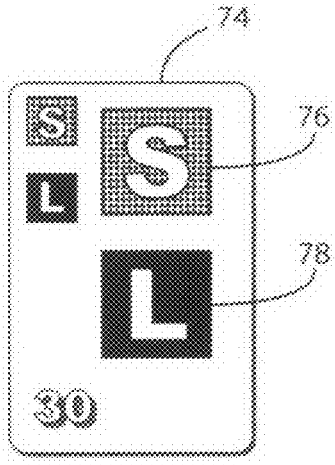
Figure 4D:
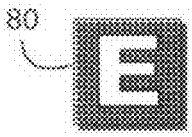
FIGS. 4D and 4E are plan views of dice of particular visual coding characteristics, which may be used with the apparatus shown in FIG. 1.
Figure 4E:
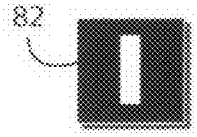
Figure 5:
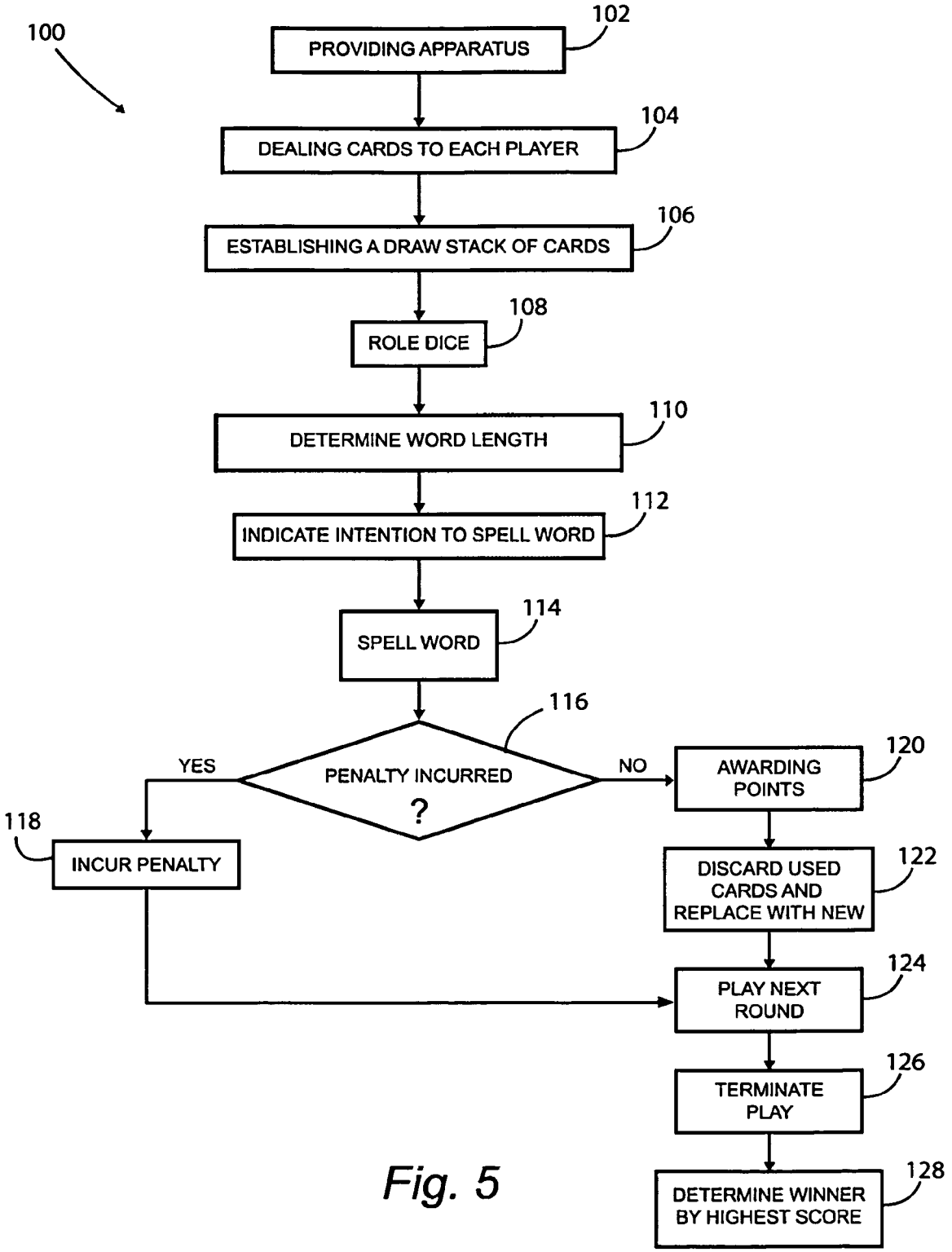
FIG. 5 is a block diagram summarizing steps of a method of playing a word forming game using the apparatus shown in FIGS. 1 through 4A-4E.

FIGS. 4A, 4B, 4C, 4D and 4E show an exemplary embodiment of the invention having cards and dice utilizing an alternative visual coding implementation to that shown in FIG. 1. In FIG. 4C, card 74 is shown to have a medium light colored designated space 76 displaying a light colored letter, namely the letter "S," and a dark colored designated space 78 displaying a light colored letter, namely the letter "L," wherein the letters "S" and "L" of card 74 are visually the same coloring as each other. Hence, the letters of card 74 are distinguished from one another by the different background coloring, as can be seen in FIG. 4C. Cards 62 and 68 shown in FIGS. 4A and 4B utilize the same visual coding implementation as card 74 shown in FIG. 4C. FIGS. 4D and 4E show a plan view of vowel dice 80 and 82 having a visual coding implementation corresponding to that utilized by cards 62, 68 and 74 shown in FIGS. 4A, 4B and 4C. The color combinations may be varied, while a color may include black, white and shades of gray, as well as colors. The color combinations are chosen such that the visual identifiable families are readily distinguished from one another. For example, a first visually identifiable family may utilize a white letter on a red background, and a second visually identifiable family may utilize a white letter on a purple background. Further, visual coding may be provided by mere outline of a letter, such as shown on the die of FIG. 2B, as long as such visual coding is readily distinguishable from the visual coding of another visually identifiable family of letters.

Functions of the above described apparatus will become apparent as the play of the game is described. The invention may be thought of as the apparatus as described above and shown in any of the FIGS. 1, 2A-2B, 3A-3B, and 4A-4E, and also as a method of play.

The method 100 of playing a game based on word forming skills may comprise a step 102 of providing apparatus of play including many of the elements described with reference to FIGS. 1, 2A-2B, 3A-3B, and 4A-4E, but certainly including dice such as the dice 12 . . . 22 and cards such as the cards 26 . . . 38. The provided apparatus may include a device which may serve as a manipulable or manually engageable indicator to be manually manipulated by a player to indicate that that player is forming a word, such as the die 58. The letter bearing dice such as the dice 12 . . . 22 and cards such as the cards 26 . . . 38 are visually coded to organize their displayed letters into at least two visually identifiable families.

It is a condition of the game that letters selected for forming words must all be from the same visually identifiable family, which selected family is present with both vowels shown on dice such as the dice 12 . . . 22 and also with consonants shown on cards such as the cards 26 . . . 38, so that words may be spelled from the letters collectively displayed thereon. Each player also has a means of indicating that he or she is actively about to play by spelling a word. This is the function of the die 58. When the number die 24 is cast, each player immediately discerns the number of letters which are necessary to satisfy the requirements of the game. Casting of the number die 24 and casting of the vowel dice such as the dice 12 . . . 22 initiates a race by each player to spell a word before his or her competitors do. The number die 24 may be rolled at the same time, before, or after the vowel dice such as the dice 12 . . . 22. In an exemplary embodiment of the invention, the number die 24 and the vowel dice 12 . . . 22 are rolled together at the same time.

As an option, the step 102 may further comprise providing a wild letter die such as the wild letter die 60, as use of the wild letter feature enabled by the wild letter die 60 is optional. The wild letter die 60 may display a letter such as the letter "E", which may be used in combination with the letters of any visually identifiable family. The wild letter die 60 may display the vowels A, E, I, O, U and Y such as displayed on the dice 12 . . . 22.

As reflected by a step 104, a predetermined number of cards such as the cards 26 . . . 38 are dealt to each player. In a currently preferred form of the game, each player is initially dealt a total of seven cards. Optionally, greater or fewer than seven cards may be dealt to each player. The deck of cards is greater than that number required to initially provide cards to each player. The deck of cards should contain enough cards to ensure a reasonable number of rounds of play. In a currently preferred form of the game, the deck may contain a total of sixty three cards. Optionally, the deck may contain more or less than sixty three cards, such as containing fifty two cards, for example. Cards left over after players have been dealt their hand of cards are utilized in a step 106 of establishing a draw stack of cards. The draw stack serves the purpose of replenishing discarded cards in a subsequent phase of play, as will be further detailed hereinafter.

Also prior to actual play comes a step of placing a manipulable object such as the die 58 in a place where it can be snatched up or otherwise manually engaged by any one player. Said step may comprise providing one object for use by all players, wherein the first player to seize possession will be the player to enjoy the opportunity to spell a word. Where one object such as the die 58 is employed, that object is placed on a playing surface (not shown) in a location equally reachable by all players. Alternatively, individual objects may be provided to each player instead of providing one object for use by all players, such as individual game pieces, bells which may be rung or lights which may be illuminated (neither option is shown), or other indicators, to establish which player is first to enjoy the opportunity to spell a word. The playing surface may be a table top, a board or fabric furnished as part of the game apparatus, or any other suitable surface.

Actual play starts with a step 108, which is rolling onto a playing surface (not shown) all of the dice such as the vowel dice 12 . . . 22, the number die 24, and the wild letter die 60, if used. The step 108 may further comprise having a player designated as the dealer roll the dice. Alternatively, and as may be required by rule after the first round of play has been played, rolling may be performed by the winner of the prior round of play.

Rolling the dice onto the playing surface initiates a race by the players to be first to form and prepare to spell a word from the letters displayed by the dice rolled onto the playing surface. To spell a word, the game comprises a step 110 of determining the length in number of letters of a word to be spelled. The step 110 may comprise constraining the number of letters to be exactly the number indicated by a number generating device such as the number bearing die 24. Alternatively, the number of letters may be a minimum of that number generated by the number generating device, or the number of letters may be a maximum of that number generated by the number generating device.

When a player has discerned the letter length requirement from the step 110, he or she must scan his or her available letters and mentally arrange them to form a suitable word. It must be borne in mind that letter combinations must be taken from the same visually identifiable family of letters. The game proceeds by having players compete to be the first to indicate the intention to spell a word. This is seen as step 112. The step 112 may further comprise manipulating the manually manipulable object, such as the die 58. The manipulation may be for example, grasping the die 58 or other designated object, releasing or tossing an individual playing piece, depressing a device (not shown) which sends an audible or visual signal, or otherwise engaging an object which requires manipulation. A further indication alternative may comprise having a first player verbally call out an indication or a word to be spelled. Utilizing a single graspable object such as die 58 may avoid a circumstance of two players calling out an indication or word at essentially the same time. Optionally, a time limit may be imposed for the duration of scanning the letters, determining a word and indicating intention to spell. For example, the time limit may be one minute long. This time limit could be lengthened or shortened, such as for novice or advanced play.

The first player to indicate the intention to spell a word must then spell a word, shown as a step 114. The step 114 may if desired include the requirement to announce the intended word before actually spelling it. The step 114 may be modified in certain optional ways. Optionally, the word may be spelled using the letter displayed on the wild letter die 60. In this case, it may be required by rule that if the particular letter displayed on wild letter die 60 is also available (i.e. displayed) on one or more colored die contained in the particular visually identifiable family being utilized to spell a word, then said one or more colored die of the visually identifiable family are required to be used first in the spelling of a word before use of the wild letter die 60 is permitted in spelling of that word. For example, if wild letter die 60 displays the letter "E" and the particular visually identifiable family being utilized to spell a word also includes one colored die displaying the letter "E," then a word such as "THERE" may be spelled using these two letter "E" dice, but when spelling a word such as "THEM" it would not be permitted to use the wild letter die 60 displaying "E" because the colored die displaying the letter "E" from the particular visually identifiable family must be used. By rule, the player may be required to indicate exactly which die or dice is being used to spell a word, and this may be in general. Optionally, the word may be spelled using all of the vowels available in any one visually identifiable family. That is, a player may be able to use all of the vowels of the same color scheme on the vowel dice 12 . . . 22, without leaving any of the vowels of that color scheme unused. Optionally, the word may be spelled using all of the consonants of any one visually identifiable family of the available cards, without leaving any of the consonants of that color scheme unused. Additional or bonus points may be awarded to the player who practices any or all of these optional steps. Bonus points may be awarded by multiplying card points by a predetermined factor, or by adding a predetermined point value.

The step 114 may impose additional constraints on the players. For example, optionally, the step 114 may further comprise obliging the player spelling the word to physically arrange his or her cards 26 . . . 38 and dice 12 . . . 22 so as to spell out the spelled word, rather than spelling the word vocally. Optionally, a point penalty may be assessed if this is not satisfied. An optional step of limiting time available to a player to spell a word, such as a time interval of thirty seconds, may be practiced. Alternately, it may be required that the player spell a word at the same time or immediately after the player indicates their intention to spell a word.

When the first player to satisfy the requirements of step 112 of indicating the intention to spell a word proceeds to undertake the requirements of the step 114 of actually spelling the word, two outcomes are possible. A step 116 may determine if a penalty has been incurred, which leads to these two possible outcomes. Successful attainment of all requirements may lead to a step 120 of awarding points to the successful player, when it is not determined that a penalty has been incurred in step 116. However, if any of the requirements of the step 114 of spelling the word are not satisfied, then it may be determined in step 116 that a penalty was incurred, which may lead to a step 118 of incurring a penalty.

A penalty may be incurred by using unapproved words when spelling a word. As with many word games, it is practical and perhaps necessary to establish a defined set of words which are suitable for being formed. The game may accordingly incorporate rules which define acceptable and unacceptable words. For example, rules may require that words be a member of the standard vocabulary of the language from which the words are selected, that a formed word not be an abbreviation, that a formed word may not be either suffix or prefix, and not an entire word unto itself, that a formed word not use punctuation such as a hyphen or apostrophe, that a formed word not be among those which are customarily capitalized, and that a formed word not be misspelled. A violation of any of these rules which are adopted may result in incurring a penalty.

A penalty may be incurred by mixing visually identifiable families. That is, should that player spelling a word choose letters from more than one color scheme, it may be said that the visually identifiable families have been mixed. The player may possibly spell out a word of the incorrect number of letters, which may result in incurring a penalty. Where a player has made a miscalculation of available letters or has lost track of a correct spelling, or who fails to actually spell the announced word, a penalty for failing to spell the announced word may be incurred. Where a player draws more cards when it comes time to discard and replenish cards, as will be explained hereinafter, a penalty for drawing excess cards may be incurred. A penalty may be incurred for disrupting a particular game apparatus, such as a die for example, during a round of play prior to award of points. Penalties may be imposed for other reasons if desired.

Regardless of the cause, the step 118 of incurring a penalty may comprise deducting points from the score of the offending player, in obliging the offending player to sit out the subsequent round of play, or both. If sitting out a round is invoked, then the offending player, after sitting out a round, may engage in playing the next round. It may be possible that a reason for incurring a penalty, such as any of the aforementioned reasons, may not be recognized at the time of occurrence during game play. In this case, if the round has ended, points have been awarded, cards have been discarded and replenished, and play has progressed into next round of play, then by rule a penalty may no longer be imposed for the prior concluded round of play. This may enhance the challenge of the game, as it would demand the immediate attention of all players when a player is spelling a word. This rule may be optional. Further, the assessment of any penalty may be optional, as various penalties may or may not be assessed in a particular game upon agreement by the players at the beginning of a game.

If no penalty has been incurred, then the step 120 of awarding points to a successful player, which may comprise determining a point award from the cards such as by summing up the card point values of the cards used to spell a word, may be followed by a step 122 of discarding those cards used to spell the word and replacing the discarded cards with an equal number of new cards from the draw stack. The step 122 of discarding and replacing cards following point award or the step 118 of incurring and assessing a penalty marks the end of a round of play.

In a step 124 of playing the next round, the steps starting with step 108 of rolling dice and continuing through to either step 122 of discarding and replacing cards or step 118 of incurring and assessing a penalty, as the case may be, are repeated. The step 124 of playing another round may be repeated a number of times until encountering a step 126 of terminating play. The step 126 may be invoked by exhausting cards of a player, exhausting cards of the draw stack, a player accumulating a predetermined point total, reaching a predetermined time-limit or a particular time of day, playing a predetermined number of rounds, or agreement between players. The final step 128 is that of determining the winner by identifying the highest point score following termination of play in step 126.

Reducing the number of candidate words which meet the game criteria may be practiced by imposing certain constraints, such as specifying word length, among others. Therefore, adoption of constraints may be used in establishing a skill level for the game as a whole, where multiple levels of skill are possible, or may be reflected in appropriate adjustments to scores. Still other criteria may be invoked to modify scores. It will be appreciated that words in any one language occur in differing frequencies. It would be possible to provide letters in proportion to their occurrence in a language on the cards and dice. Point awards for forming words may be established to reflect frequency of occurrence, for example by increasing point awards for letters which have relatively low frequency of occurrence in the selected language.

The letter "Y" may be treated as a consonant, or as a vowel, or may be represented on the cards and dice as both consonant and vowel. In a preferred embodiment of the invention, the letter "Y" is displayed on the dice 12 . . . 22 and 60.

The apparatus of the game 100 may be varied from the embodiments set forth above. For example, the wild letter die 60 may be modified such that rather than display a particular letter, it may allow a player to be given discretion to select a letter rather than being constrained to use letters which are displayed on the dice. For example, the wild letter die 60 may display one or more blank faces, or display a symbol, such as a logo, special indicia, a joker character, a trademark, etc. to indicate such. A similar feature may be used with the cards such as the cards 26 . . . 38. This is the purpose of the cards 62 and 68 seen in FIGS. 4A and 4B. The designated spaces for displaying a letter, ordinarily established within a border such as the borders 64, 66, 70 and 72, may include a designated space which is blank or characterized by a symbol, such as a logo, special indicia, a joker character, a trademark, etc. as a so-called wild letter space.

The phrase "at least" will be understood to contemplate both two and also any number greater than two. For example, although the game has been presented in terms of two visually identifiable families of letter bearing members, the number of visually identifiable families may be increased to three or more. Hence description of at least two visually identifiable families allows for a more advanced or complicated game wherein there are three or more visually identifiable families of letter bearing members. The number of dice such as the dice 12 . . . 22 or of cards such as the cards 26 . . . 38 or both may be adjusted accordingly.

The number display device represented by the die 24 may take other forms, such as a card, a spinning device, an electronic device, and still others, as long as it can generate numbers randomly from a range of numbers.

It will be apparent that the relative roles of cards and dice, such as the cards 26 . . . 38 and the dice 12 . . . 22 may be reversed or otherwise modified.

It will be appreciated that visual contrast for the purpose of establishing two or more different visually identifiable families may vary from those described and shown herein. For example, letter colors and background colors may be selected to establish color coding or visually identifiable families. Letters and numbers may be rendered in other ways than the solid renderings illustrated, such as by being stippled, striped, or otherwise varied in appearance.

Locations of indicia on cards may vary from those examples used. Additional indicia bearing members (not shown) may be used so that only letters appear on cards such as the cards 26 . . . 38, with numerical values corresponding to the point value of a letter or card being borne on the additional indicia bearing members. Alternately, numerical point values may be given to vowel letters on the dice. Numerical values may alternately be determined by word length, or be a set value per word.

It would also be possible to assign two functions to any one form of indicia. For example, the numerical value for establishing a point award may be based on displayed letters of cards such as the cards 26 . . . 38, dice such as the dice 12 . . . 22, or other devices (not shown). Illustratively, the game apparatus may include a table assigning a numerical value to each letter of the alphabet. The score could be determined by using those numerical values associated with the vowels used in the successfully spelled word, the consonants used in the successfully spelled word, or all of the letters of the successfully spelled word.

Also, the game apparatus may incorporate other forms of apparatus, such as electronic displays in place of for example the dice such as the dice 12 . . . 24 and 58 and 60, and cards such as the cards 26 . . . 38 and 52. The game may be implemented as an application usable on a data processor such as a personal computer, laptop computer, handheld computer, a game player, or smart phone, such as an iPhone®, and may be presented on a display screen. The game may be played by geographically separated players, using the Internet, cellular telephone, wireless networking, or other available communications devices.

Steps of the method 100 of playing the novel game may be modified as desired. It is not necessary to adopt every feature of the game described above; accordingly, some steps may be deleted from any one version of the game and others may be modified.

While the present has been described in connection with what is considered the most practical and preferred embodiments, it is to be understood that the present invention is not to be limited to the disclosed arrangements, but is intended to cover various arrangements which are included within the spirit and scope of the broadest possible interpretation of the appended claims so as to encompass all modifications and equivalent arrangements which are possible.

I claim:

1. Apparatus for playing a word forming game, comprising:

a plurality of dice each having a plurality of faces each bearing a vowel letter, with a plurality of vowels of the alphabet being represented on the faces;

a plurality of cards each having a face bearing a plurality of letters;

wherein the vowel letters of the dice and the letters of the cards are visually coded to establish at least a first visually identifiable family of code related letters and a second visually identifiable family of code related letters, wherein at least one of the letters of each card is a member of said first visually identifiable family of code related letters, and at least another one of the letters of each card is a member of said second visually identifiable family of code related letters, and the plurality of vowel bearing dice comprises at least one vowel bearing die which is visually coded as a member of said first visually identifiable family of code related letters and at least one other vowel bearing die which is visually coded as a member of said second visually identifiable family of code related letters; and a number generating device which is a component unto itself and is functional to generate a plurality of different numbers, wherein a number generated by the number generating device corresponds to a number of letters that may be used to form a word from one of the at least first and second visually identifiable families of code related letters on the cards and dice.

2. The apparatus of claim 1, wherein the letters borne on the faces of the cards are consonant letters.

3. The apparatus of claim 1, wherein said number of letters that may be used to form a word may be exactly the number generated by the number generating device, or may be a minimum of the number generated by the number generating device, or may be a maximum of the number generated by the number generating device.

4. The apparatus of claim 3, wherein there are at least two dice which are members of one of the visually identifiable families of code related letters, and at least two dice which are members of another one of the visually identifiable families of code related letters.

5. The apparatus of claim 1, wherein each card displays a numerical value in addition to the plurality of letters, which value may vary from card to card.

6. The apparatus of claim 1, wherein the number generating device is a number display die having six faces each displaying one number, and the numbers range in magnitude between two and five.

7. The apparatus of claim 1, wherein the letters borne on each card appear at least along the left side border of each card in a vertical array such that at least one representation of all of the letters borne on the card would be readable from the vertical array even if that card were mostly covered by another card.

8. The apparatus of claim 1, wherein the cards have designated space thereon for displaying letters, and wherein on at least one card, a designated space may be blank.

9. The apparatus of claim 1, further comprising:

a manually manipulable indicator which is a component unto itself and is functional to be manually manipulated by a player.

* * * * *